US008540311B1

(12) United States Patent
Ablett

(10) Patent No.: US 8,540,311 B1
(45) Date of Patent: Sep. 24, 2013

(54) MAGNETICALLY SUSPENDED CHAIR DEVICE

(76) Inventor: Paul Ablett, Flemington (AU)

( * ) Notice: Subject to any disclaimer, the term of this patent is extended or adjusted under 35 U.S.C. 154(b) by 46 days.

(21) Appl. No.: 13/412,852

(22) Filed: Mar. 6, 2012

(51) Int. Cl.
*A47C 31/00* (2006.01)
*A47C 1/00* (2006.01)

(52) U.S. Cl.
USPC ..... 297/217.3; 297/344.18

(58) Field of Classification Search
USPC ..... 297/217.1, 217.3, 217.7, 344.12, 297/344.18
See application file for complete search history.

(56) References Cited

U.S. PATENT DOCUMENTS 4,545,616 A * 10/1985 Booth ..... 297/320
4,842,233 A 6/1989 Rusin
D327,585 S 7/1992 Hollington
5,209,322 A 5/1993 McMahon
5,490,713 A * 2/1996 Fukuoka ..... 297/217.3
6,637,820 B2 10/2003 Rogers, III et al.

FOREIGN PATENT DOCUMENTS

KR 2010006040 U * 6/2010
WO WO 2012127258 A1 * 9/2012

* cited by examiner

*Primary Examiner* — Milton Nelson, Jr.

(57) ABSTRACT

The magnetically suspended chair device provides cushioned seat suspension above the base, as well as a unique aesthetic appeal. As proximity of the magnets increases repulsive forces, the second electromagnet of the seat bottom will not contact the first electromagnet of the seat base. Depending upon the seat bottom and seat back design, and the load imposed by a user thereon, the electromagnets are either centrally or off-center disposed. The arm assemblies guide the seat assembly in upward and downward movement away from and toward the base.

6 Claims, 6 Drawing Sheets

MAGNETICALLY SUSPENDED CHAIR DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Chair designs have an almost unendingly displayed number of possibilities. Chair designs are typically driven by comfort and aesthetic appeal. The present device provides unique features in both comfort and appeal.

FIELD OF THE INVENTION

The magnetically suspended chair device relates to chairs and more especially to a chair device that provides an electromagnetically suspended seat for comfort and aesthetic appeal.

SUMMARY OF THE INVENTION

The general purpose of the magnetically suspended chair device, described subsequently in greater detail, is to provide a magnetically suspended chair device which has many novel features that result in an improved magnetically suspended chair device which is not anticipated, rendered obvious, suggested, or even implied by prior art, either alone or in combination thereof.

To attain this, the magnetically suspended chair device provides cushioned seating by electromagnetically suspending the seat above the base. This uniquely designed seating further provides aesthetic appeal. The controls may provide only an on/off for the electromagnets. As proximity of the magnets increases repulsive forces, the second electromagnet of the seat bottom will not contact the first electromagnet of the seat base. Additionally, the controls may adjustably control the electromagnets to allow a user to position the height of the seat.

Depending upon the seat bottom and seat back design, and the load imposed by a user thereon, the electromagnets may be either centrally or off-center disposed. The arm assemblies may be parallel. The arm assemblies may also be antiparallel, with the guides of the seat assembly in automatically adjusted contact with the arm assemblies.

Thus has been broadly outlined the more important features of the improved magnetically suspended chair device so that the detailed description thereof that follows may be better understood and in order that the present contribution to the art may be better appreciated.

An object of the magnetically suspended chair device is to provide comfortable seating.

Another object of the magnetically suspended chair device is to provide comfortable seating by means of an electromagnetically suspended seat.

A further object of the magnetically suspended chair device is to provide unique aesthetic appeal.

An added object of the magnetically suspended chair device is to be easily operated by a user.

A further object of the magnetically suspended chair device is to provide for seat height adjustment.

These together with additional objects, features and advantages of the improved magnetically suspended chair device will be readily apparent to those of ordinary skill in the art upon reading the following detailed description of presently preferred, but nonetheless illustrative, embodiments of the improved magnetically suspended chair device when taken in conjunction with the accompanying drawings.

DETAILED DESCRIPTION OF THE DRAWINGS

With reference now to the drawings, and in particular FIGS. 1 through 6 thereof, the principles and concepts of the magnetically suspended chair device generally designated by the reference number 10 will be described.

Figure 1:
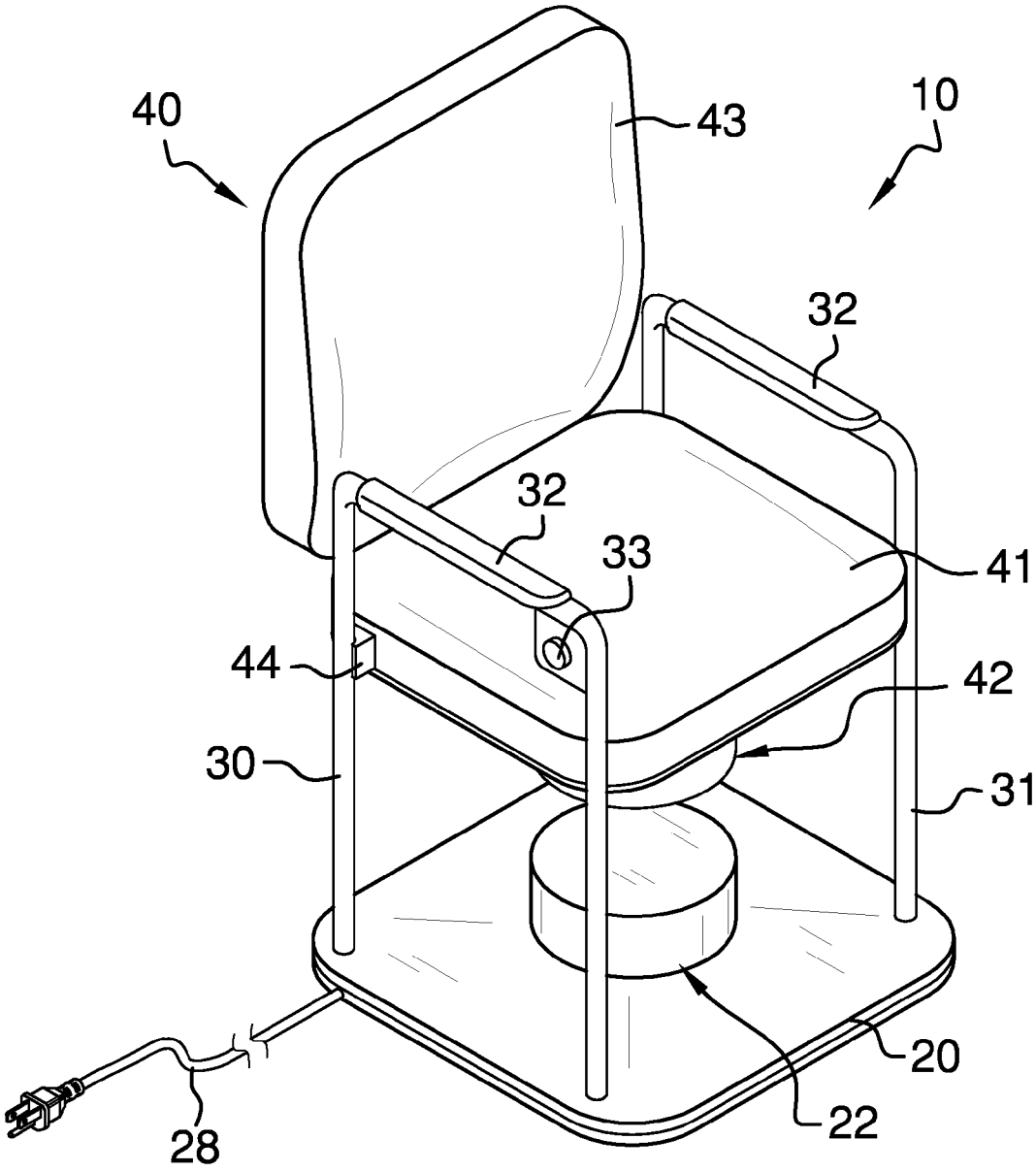
FIG. 1 is a perspective view.

Referring to FIG. 1, the device 10 partially comprises a base 20. A first electromagnet 22 is centrally and upwardly disposed on the base 20.

Figure 5:
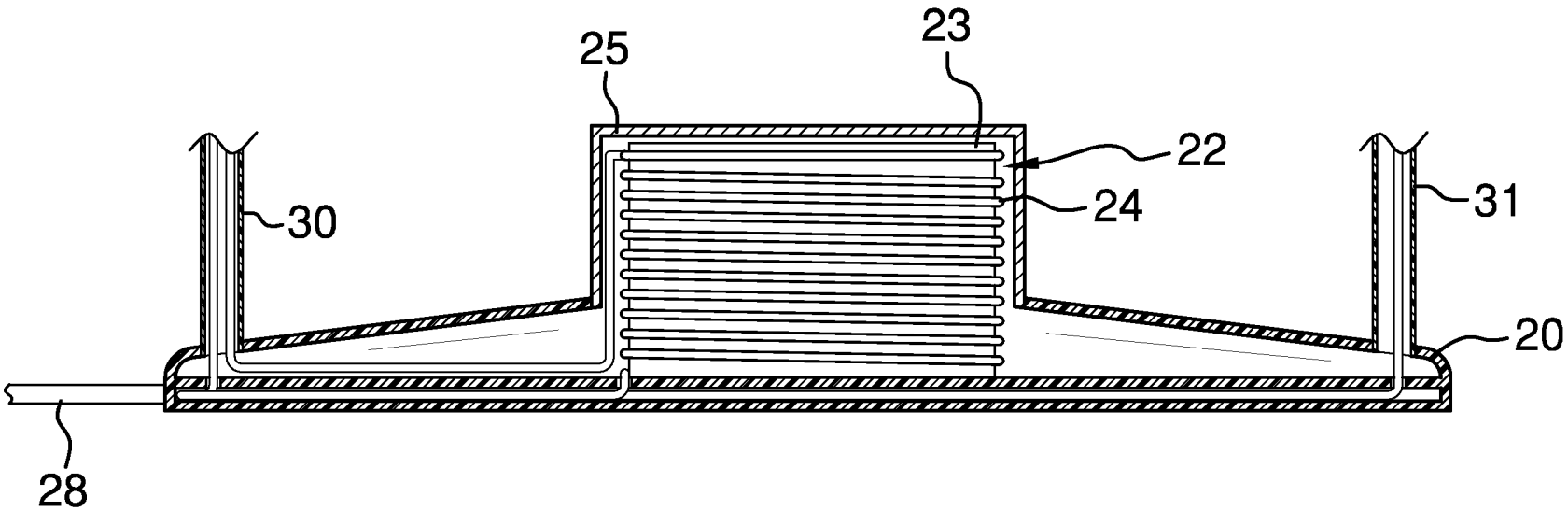
FIG. 5 is a partial cross sectional view of FIG. 2, taken along the line 5-5.

Referring to FIG. 5, the first electromagnetic 22 has a core 23 surrounded by a coil 24.

Figure 6:
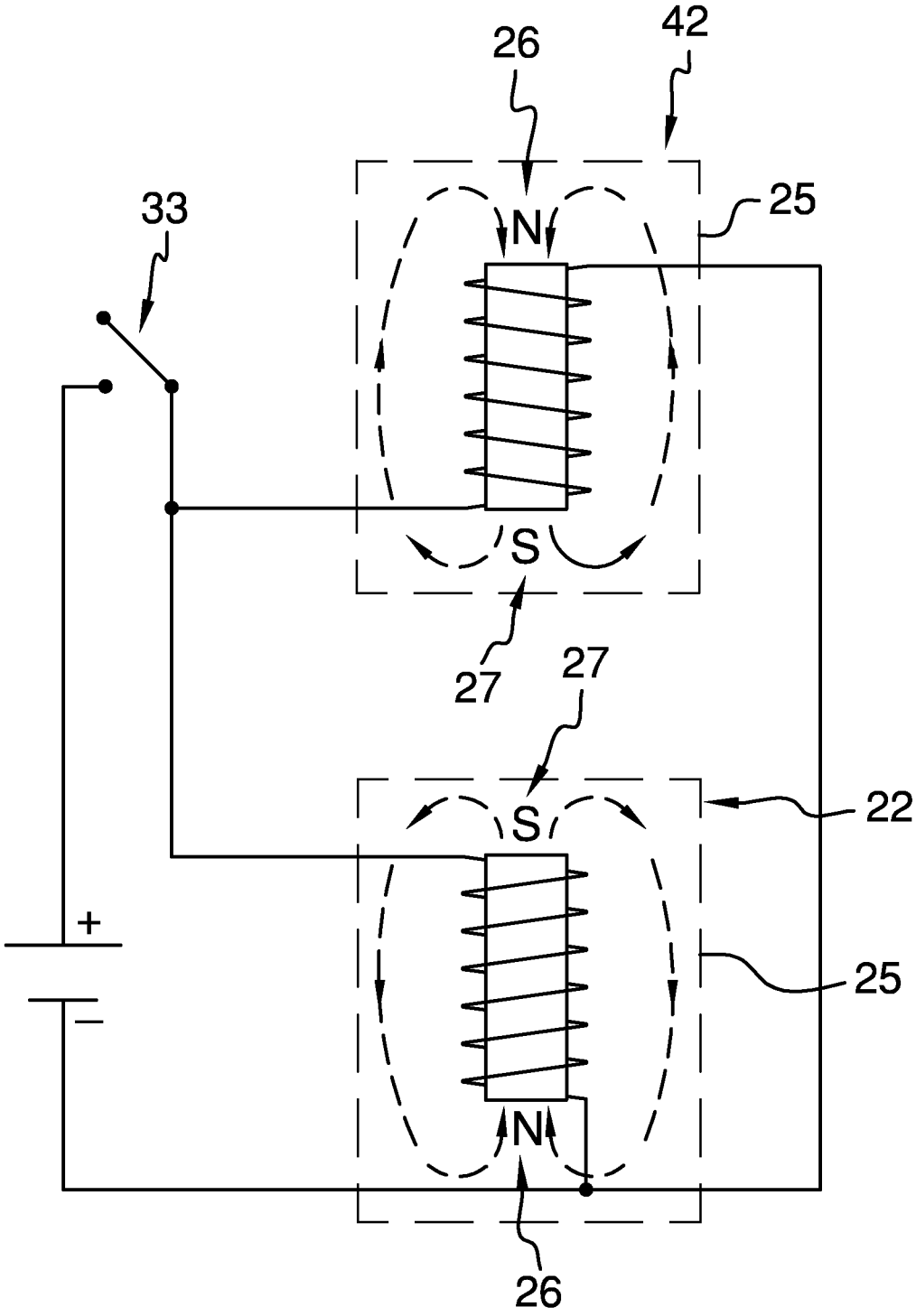
FIG. 6 is lateral elevation view of interaction of the electromagnet poles.

Referring to FIG. 6, the first electromagnet 22 and the second electromagnet 42 each has a first pole 26 spaced apart from a second pole 27. A magnet case 25 surrounds the first electromagnet 22 and the second electromagnet 42.

Figure 4:
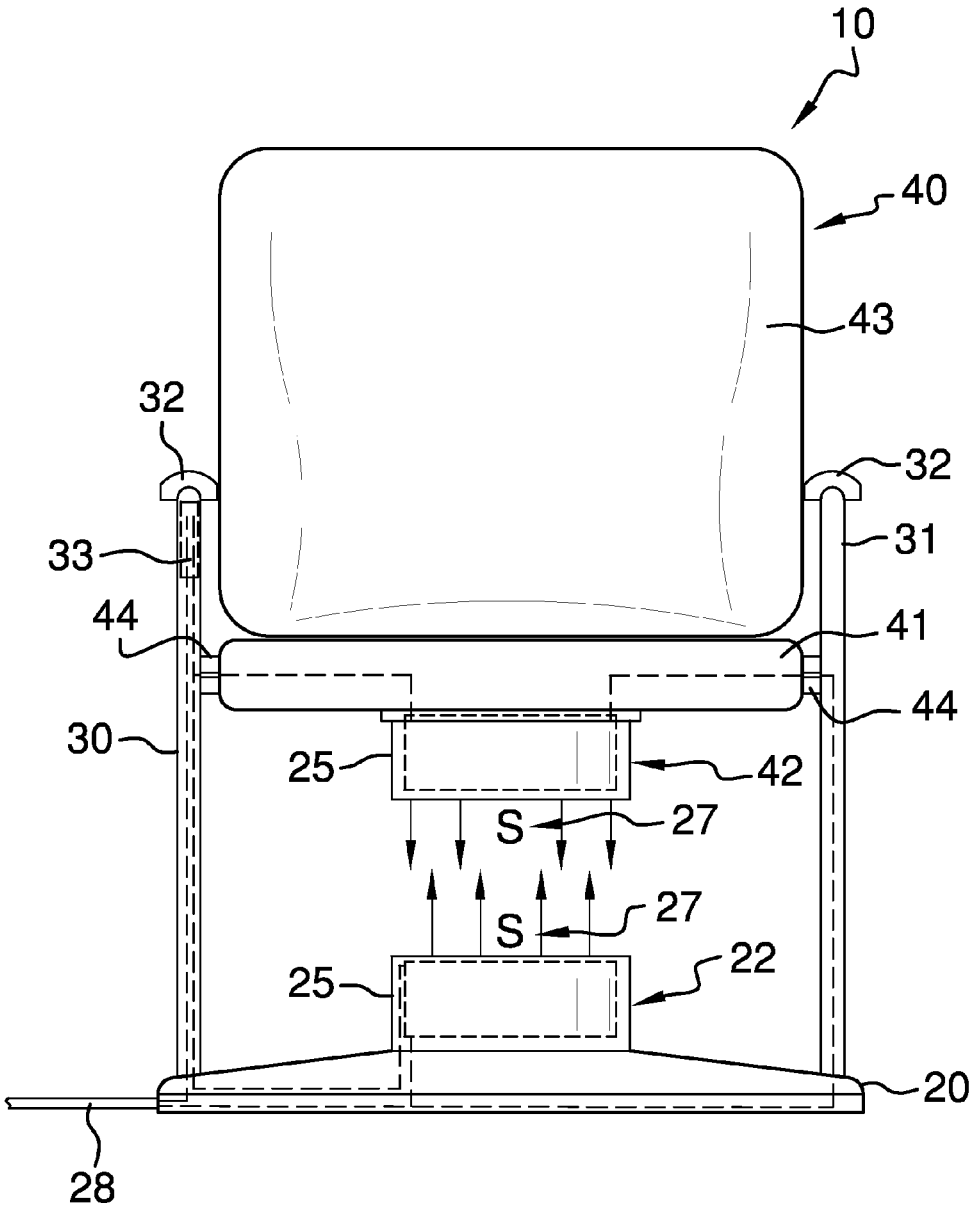
FIG. 4 is a front elevation view.

Referring to FIG. 4, a power supply 28 is connected to the first electromagnet 22.

Figure 2:
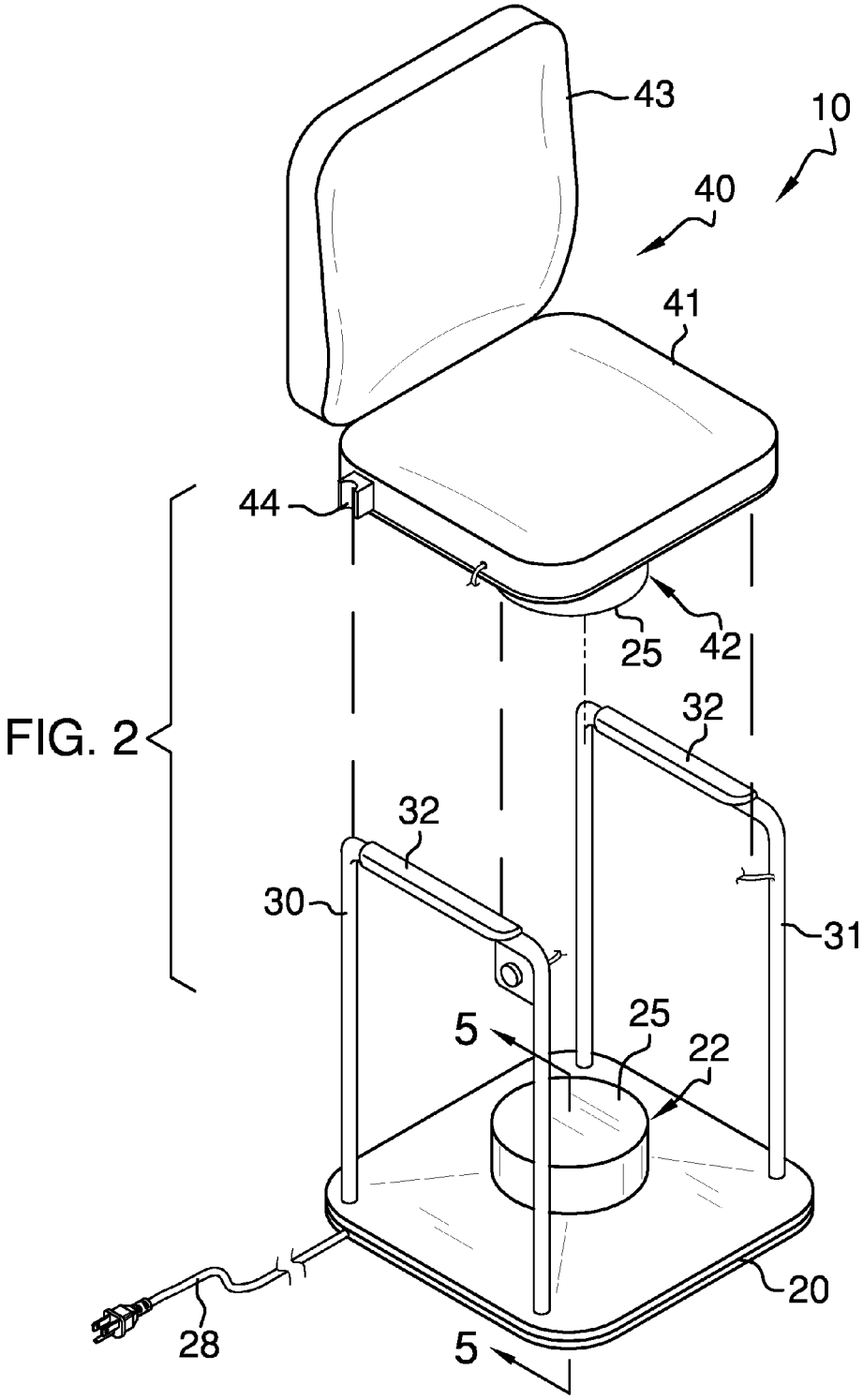
FIG. 2 is a perspective view, seat assembly elevated off of base and arm assemblies.

Referring to FIG. 2, a first arm assembly 30 is positioned upwardly on the base 20. A second arm assembly 31 is spaced apart from the first arm assembly 30 and positioned upwardly on the base 20. The second arm assembly 31 is parallel with the first arm assembly 30. A pad 32 is disposed atop each arm assembly. A controls 33 is disposed on at least one of the arm assemblies. A seat assembly 40 is provided. The seat assembly 40 has a seat bottom 41 and a seat back 43. An at least one guide 44 is disposed on an each side of the seat assembly 40. More guides 44 may be used. Each guide 44 is configured to slideably interact with one of the each of the arm assemblies, respectively.

Figure 3:
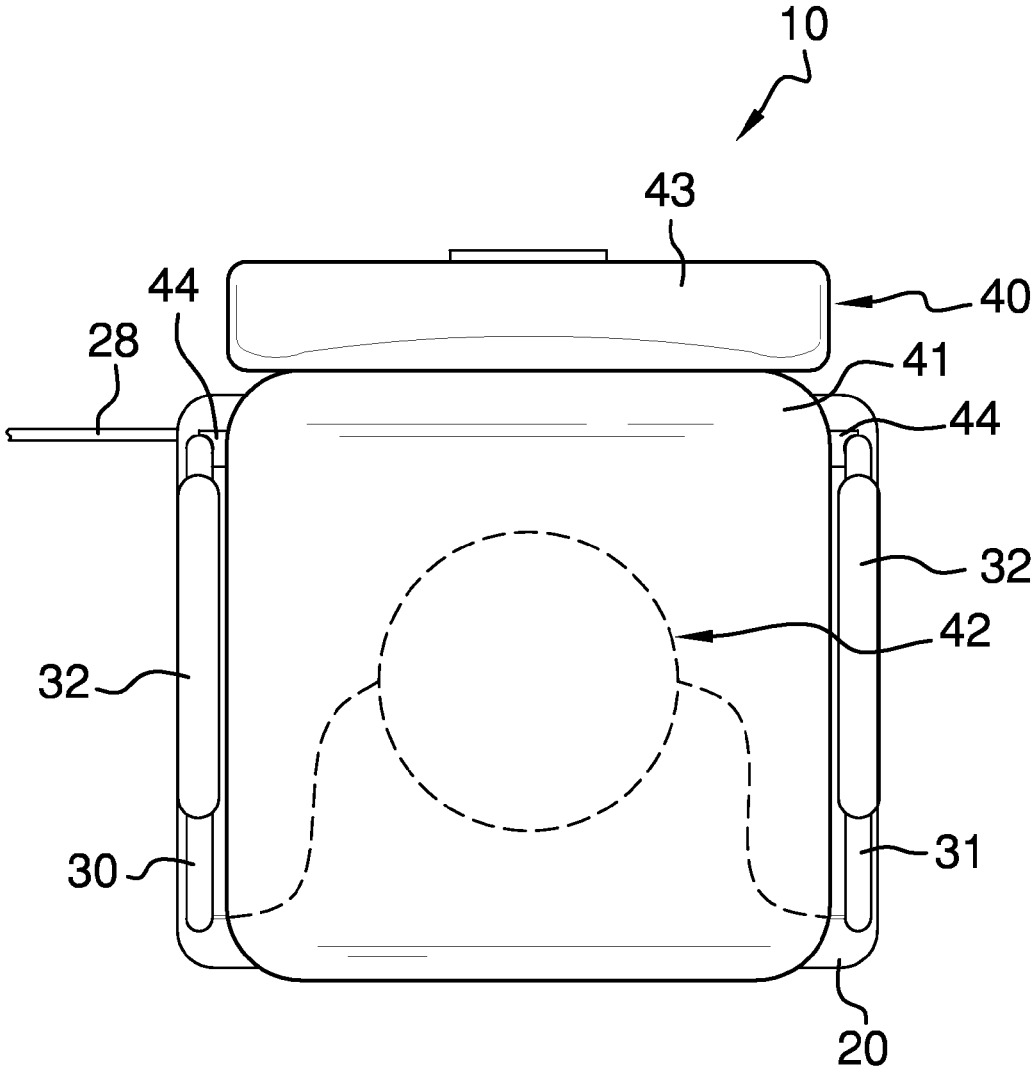
FIG. 3 is a top plan view.

Referring to FIG. 3, the second electromagnet 42 is disposed downwardly on the seat bottom 41.

Referring to FIG. 4, the second electromagnet 42 is positioned by the guides 44 to be directly above the first electromagnet 22. The second electromagnetic 42 has the core 23 surrounded by the coil 24. The second electromagnet 42 has the first pole 26 spaced apart from the second pole 27.

Referring to FIG. 6, the second pole 27 of the second electromagnetic 42 is configured to face the second pole 27 of the first electromagnet 22. The second electromagnet 42 is in communication with the power supply 28 and the controls 33. The controls 33 are configured to adjust a repulsive force of the electromagnet poles in positioning the seat assembly 40 above the base 20. The controls 33 may also be configured to non-adjustably turn on the repulsive force of the two electromagnets.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the magnetically suspended chair device may be used.

What is claimed is:

1. A magnetically suspended chair device comprising, in combination:

a base;

a first electromagnet centrally and upwardly disposed on the base, the first electromagnet having a core surrounded by a coil, the first electromagnet having a first pole spaced apart from a second pole;

a magnet case surrounding the first electromagnet;

a power supply connected to the first electromagnet;

a first arm assembly positioned upwardly on the base;

a second arm assembly spaced apart from the first arm assembly and positioned upwardly on the base;

a pad disposed atop each arm assembly;

controls disposed on at least one of the arm assemblies, the controls in communication with the first electromagnet;

a seat assembly the seat assembly having a seat bottom and a seat back;

an at least one guide disposed on each side of the seat assembly, each guide configured to slideably interact with each one of the arm assemblies, respectively;

a second electromagnet disposed downwardly on the seat bottom, the second electromagnet positioned by the guides to be directly above the first electromagnet, the second electromagnet having a core surrounded by a coil, the second electromagnet having a first pole spaced apart from a second pole, the second pole of the second electromagnet configured to face the second pole of the first electromagnet, the second electromagnet in communication with the power supply and the controls;

whereby the controls are configured to turn on a repulsive force of the electromagnets in positioning the seat assembly above the base.

2. The device according to claim 1 wherein the controls are further configured to adjust the repulsive force of the electromagnets in adjustably positioning the seat assembly above the base.

3. The device according to claim 1 wherein the arm assemblies are further parallel.

4. The device according to claim 3 wherein the controls are further configured to adjust the repulsive force of the electromagnets in adjustably positioning the seat assembly above the base.

5. The device according to claim 1 wherein the arm assemblies are further antiparallel;

the guides of the seat assembly in automatically adjusted contact with the arm assemblies.

6. The device according to claim 5 wherein the controls are further configured to adjust the repulsive force of the electromagnets in adjustably positioning the seat assembly above the base.

* * * * *